United States Patent [19]

Maes et al.

[11] 4,388,254

[45] Jun. 14, 1983

[54] SYSTEM FOR MAKING A HOMOGENEOUS AQUEOUS SLURRY-TYPE BLASTING COMPOSITION

[75] Inventors: Michel E. Maes, Bellevue, Wash.; Robert L. Shaw, Dallas, Tex.; Royal L. Reinsch, Redmond, Wash.

[73] Assignee: Energy Sciences Partners, Ltd., Seattle, Wash.

[21] Appl. No.: 154,381

[22] Filed: May 29, 1980

[51] Int. Cl.[3] ..... C06B 21/00

[52] U.S. Cl. ..... 264/3 C; 149/43; 149/109.6; 86/20 R

[58] Field of Search ..... 149/43, 109.6; 264/3 C; 86/20 R

[56] References Cited

U.S. PATENT DOCUMENTS 3,153,606 10/1964 Breza et al. ..... 149/43

3,160,538 12/1964 Zaslowsky ..... 149/43

*Primary Examiner*—Stephen J. Lechert, Jr.

*Attorney, Agent, or Firm*—Seed, Berry, Vernon & Baynham

[57] ABSTRACT

A blasting composition, method and system for making such is disclosed. The blasting composition is a homogeneous slurry-type blasting agent containing a major amount of water and a relatively small amount of a particulate fuel, preferably a particulate metal fuel. The blasting composition is made by premixing the fuel with water and a gelling agent to form a stable suspension of fuel in the water, metering the suspension of fuel into a dry particulate mixture of an inorganic metal oxidizer and a gelling agent, and slowly tumbling the mixture a short time sufficient to obtain a uniform composition without desensitizing the composition to detonation.

8 Claims, 1 Drawing Figure

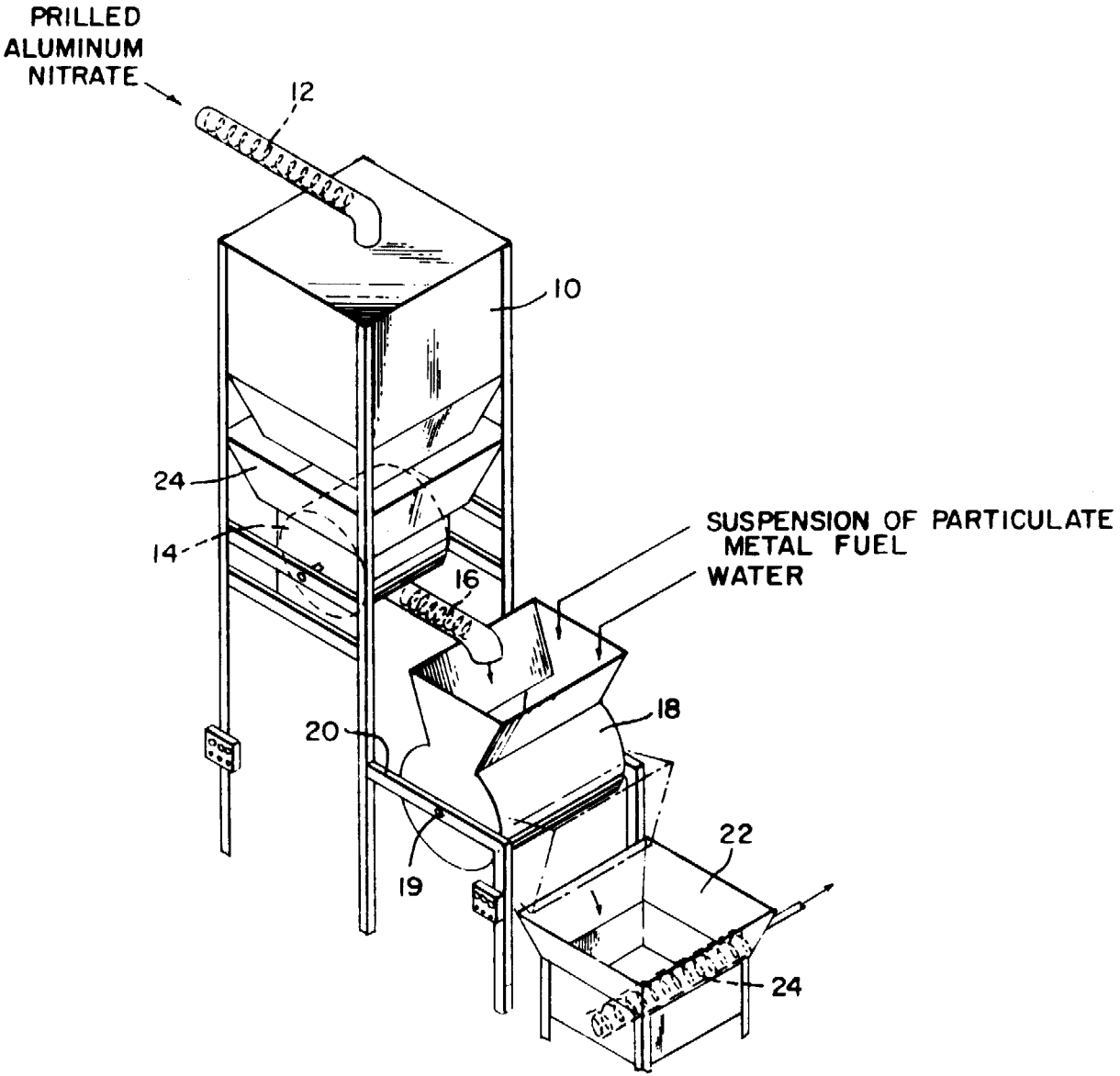
PRILLED ALUMINUM NITRATE
12
10
24
14
16
SUSPENSION OF PARTICULATE METAL FUEL WATER
18
20
19
22
24

SYSTEM FOR MAKING A HOMOGENEOUS AQUEOUS SLURRY-TYPE BLASTING COMPOSITION

BACKGROUND OF THE INVENTION

1. Field of the Invention

This invention relates to a homogeneous slurry-type blasting composition, and to a method and system for making such.

2. Prior Art Relating to the Invention

Aqueous and oil-based inorganic nitrate slurry explosives are extensively used in strip mining of coal and other construction uses. These slurry-type explosives generally contain a major amount of an inorganic nitrate and a fuel together with water or oil and a thickening or gelatinizing agent. The most common way of making slurry-type explosive compositions has generally involved employing an aqueous solution of ammonium nitrate or alkali or alkaline earth metal nitrates to which the other components are added. Finely divided aluminum flakes are commonly used in such compositions; however, "dusting" of this particulate material during manufacture of blasting compositions presents an extreme hazard. It is also difficult to obtain a homogeneous mix of the metal nitrate and metal particles without segregation. If the components are not uniformly mixed, the explosive composition either does not detonate or performs unsatisfactorily.

It has remained a problem to develop a slurry-type explosive composition which can be manufactured quickly, without the need for special equipment, at reasonable cost, and with safety.

The following U.S. patents disclose slurry-type blasting compositions and methods of making them; however, none of them employ a method or composition as described and claimed herein.

U.S. Pat. No. 3,294,601 discloses a slurry-type blasting composition of ammonium nitrate as an oxidizer, hexamethylenetetramine as a fuel, water, and a thickening or gelling agent. No particulate metal as a fuel is employed. The blasting composition is formed by mixing the ammonium nitrate, gelling agent together in a steam-jacketed vessel to melt them and slowly adding to the dry, hot melted mixture hexamethylenetetramine dissolved in boiling water, the mixture being blended until a cohesive mass is formed.

U.S. Pat. No. 3,765,967 discloses a slurry explosive prepared by dissolving an inorganic metal perchlorate in water together with a thickener and particulate pentaerythritol tetranitrate and adding finely divided aluminum to the aqueous slurry.

U.S. Pat. No. 5,985,593 discloses a method of making a slurry explosive by solubilizing nitromethane in an aqueous gel of sodium perchlorate which includes a solubilizing agent for the nitromethane, such as ethylene glycol.

U.S. Pat. No. 3,787,254 discloses a water-base slurry composition made by distributing a liquid hydrocarbon fuel in an emulsion-like form of a mixture of ammonium nitrate and calcium nitrate, and then adding a thickening or gelling agent. Aluminum metal is added as a secondary fuel for certain of the compositions.

U.S. Pat. No. 3,886,010 discloses a water-base slurry composition made by incorporating a small amount of a thickener to an aqueous oxidizing solution of amonium nitrate and thereafter adding a dry mix of a particulate solid fuel, such as finely divided aluminum, to the solution by stirring and mixing, the dry mix including a supplemental thickening agent and a cross-linking agent.

U.S. Pat. No. 3,378,416 discloses an explosive slurry made by melting together the liquefiable component of the composition, i.e., ammonium nitrate and sodium nitrate, and then mixing in a dough-type mixer the mixture of the metal nitrates and a carbonaceous fuel, such as starch or woodmeal; a particulate metal, such as aluminum powder or flake; water; and a thickening agent, if needed. It is essential to melt the liquefiable ingredients first and then add the fuel and other ingredients to avoid spontaneous ignition thereof.

U.S. Pat. No. 3,235,425 discloses a sequence of steps for mixing a slurry-type blasting composition by mixing together a dry mixture of ammonium nitrate and a gelling agent, then adding the resulting dry mix to water, and thereafter mixing in a smokeless powder.

None of the patents disclose a sequence of mixing steps to avoid dusting of particulate metal such as aluminum used as a fuel in the production of blasting compositions nor a method which avoids desensitizing the composition during manufacture.

SUMMARY OF THE INVENTION

It is a primary object of this invention to provide a method of quickly formulating an aqueous, slurry-type blasting agent safely and economically.

It is a further object of this invention to provide a method of formulating a homogeneous, aqueous, slurry-type blasting agent using flaked aluminum, with little or no dusting of the aluminum.

It is a further object of this invention to provide an aqueous, slurry-type blasting composition wherein the two components of the blasting composition can be separately packaged and mixed together quickly and safely without the need for sophisticated equipment and without desensitizing the composition.

It is a further object of this invention to provide an aqueous, slurry-type blasting agent employing no toxic ingredients and which can be handled in an open plant.

It is a further object of this invention to provide an aqueous, slurry-type blasting agent employing a high proportion of water and a relatively small amount of particulate aluminum and still obtain a blasting composition having good blasting characteristics.

It is a further object of this invention to provide a two-component aqueous slurry-type blasting agent employing dry, particulate ammonium nitrate, the endothermic reaction occurring when the dry ammonium nitrate is mixed with the aqueous fuel suspension providing greater thermal stability and insensitivity.

These and other objects are accomplished by premixing a fuel with water and a gelling agent to form a stable suspension of the fuel in the water, mixing together (in dry form) a particulate nitrate oxidizer together with a gelling agent, and blending the suspension and dry mixture by subjecting them to a slow tumbling action for a brief period of time. The blasting composition comprises 50–80 percent by weight ammonium nitrate, 0.5–10 percent fuel, preferably flaked aluminumin an amount ranging from 1–4 percent, 15–35 percent by weight water, 0.5–10 percent gelling agent, preferably 1–2 percent, 0.02–0.5 percent of a cross-linking agent and, optionally, 0.05–1 percent of a glycol, such as ethylene or propylene glycol.

BRIEF DESCRIPTION OF THE DRAWINGS

The drawing illustrates a schematic diagram of a batch mixing system for formulation of an aqueous, slurry-type blasting composition of the type disclosed herein.

DESCRIPTION OF THE PREFERRED EMBODIMENTS

The inorganic nitrate which is preferably employed as the nitrate component of the explosive composition of this invention is ammonium nitrate; however, other inorganic nitrates can be employed alone or in admixture with the ammonium nitrate, such as the alkali or alkaline earth metal nitrates; e.g., sodium nitrate, potassium nitrate, calcium nitrate. If a mixture is used, it should generally contain a predominant amount of ammonium nitrate in preference to the other nitrates. The nitrate used can be in any form; i.e., crushed, prill or a combination of the two, reasonably oil and water-free. Fertilizer-grade ammonium nitrate is suitable. The particulate nitrate is usually processed through a hammermill or other means to grind it to a uniform particulate size before being blended with the other components in the explosive composition. Although a dry gelling or thickening agent may be added to the oxidizer, it is preferable to add the gelling agent and cross-linking agent to the aqueous suspension to avoid any problems of (1) premature cross-linking, should the ammonium nitrate become damp, or (2) toxicity, which is a problem with certain of the cross-linking compounds. The thickening agents may be any of the conventional thickening agents employed in the preparation of slurry explosives, such as guar gum, starches and synthetic polymers, such as the polyacrylamides. Cross-linking agents may also be added for the thickening agent. Cross-linking agents are especially useful where the stability or integrity of the composition needs to be maintained. The cross-linking agents are generally metal salts, such as ferric nitrate, sodium dichromate, ammonium, antimony salts, etc. The inorganic nitrate, with or without the gelling agent and cross-linking agent, in dry form, forms one component of the two-component explosive composition.

The second component of the explosive composition is comprised of a fuel, preferably a finely divided metal, such as aluminum, which is premixed with water and a gelling or thickening agent which suspends and causes the aluminum to be absorbed by the water. Preferred is de-dusted aluminum flake which includes a coating of a polyfluorocarbon and/or a metal stearate to prevent reaction with water. Alcoa 1651 manufactured by the Aluminum Company of America, is suitable, as are other commercially vailable aluminum flake products. This particulate aluminum is susceptible to dusting if disturbed, for example, by vibration, and is extremely hazardous to use if dusting cannot be prevented during mixing of the explosive composition. It was found that premixing the aluminum particles with water and a gelling agent substantially eliminated dusting. The gelling or thickening agent employed can be the same as that blended with the dry inorganic oxidizer. Preferred is one of the guar gums, preferably used without a cross-linking agent. It is also desirable to add a small amount of a glycol, such as propylene glycol, to the suspension to aid in dispersing the gelling agent. The amount of water blended with the particulate aluminum and gelling agent should be only enough to form a concentrate of aluminum suspended in an aqueous system. An impeller, vortex mixer is preferred for preparation of the concentrate. This concentrate can be packaged in suitable cartridges and shipped to the intended blending site for blending with the first component. At the use site, the two components of the explosive composition are blended together with additional water to produce an aqueous, slurry-type blasting agent which can be used with safety.

Reference is made to the drawing illustrating a schematic diagram of the equipment used for blending the explosive composition. The particulate ammonium nitrate or other inorganic nitrate or mixture thereof is delivered into a bin 10 by an auger 12 coming from a bulk facility holding the nitrate. The inorganic nitrate drops into a hammermill 14 which grinds the inorganic oxidizer to a uniform particle size. The ground inorganic nitrate exits from the hammermill and is conveyed by auger 16 to a mixer 18, similar to a conventional mortar mixer. A dry gelling agent may be added to the oxidizer in the mixer. The mixer incorporates mixing blades within it which slowly tumble the dry, particulate mixture. The mixer is pivotally mounted at pivot point 19 to frame members 20 for dumping the mixture, after blending of the second component, into a bin and auger packer 22 as illustrated. A scale 24 is included beneath hopper 10 for measuring a predetermined weight of the dry particulate oxidizer to be fed into the mixer 18. When formulating the explosive composition, a predetermined weight of the dry particulate oxidizer, as weighed by the bag scale 24, is fed into the hammermill 14 and into the mortar mixer 18.

The second component of the explosive composition (the concentrate of particulate aluminum suspended in an aqueous slurry) is poured into the mortar mixer simultaneously with or prior to the addition of a predetermined amount of additional water. Once the second component is added to the dry particulate mixture in the mixer, the mixer is activated to slowly tumble the mixture only for a short period of time, generally 2 to 30 seconds. If the mixture is mixed too rapidly, the sensitivity of the explosive composition is destroyed. If mixed too slowly, a non-uniform composition is obtained. If the mixture is mixed too rapidly, the aluminum will dust. After the short mixing time of the two components, the mixture, having a molasses-like consistency, is dumped into the auger packer 24, where it is packed in polyethylene or other plastic packages or cartridges. The mixer 18 is provided with an interlock mechanism which prevents mixing until the proper amounts of the two components have been added to the mixer. The final explosive composition should have a composition consisting essentially of 50–80 percent by weight ammonium nitrate or other inorganic nitrate or mixtures thereof, 0.5–10 percent particulate aluminum, preferably 1–4 percent, 15–35 percent water, 0.5–10 percent gelling agent, 0.02–0.5 percent cross-linking agent and 0.05–1.0 percent of a glycol, such as ethylene or propylene glycol.

The equipment needed to formulate the explosive composition is unsophisticated and the components, particularly the aluminum-containing component, can be packaged as a gel in concentrated form for transport to the formulation site. The ammonium nitrate or other inorganic nitrate can be acquired from any suitable source. The composition can be formulated quickly with no dusting problems and with safety. The final composition uses a relatively small amount of particulate aluninum. No other fuel is needed. A relatively high proportion of water is used in contrast to other commercially used slurry-type explosive compositions. The aluminum content may be varied to vary the sensitivity of the explosive composition. Above about 3 percent aluminum the explosive composition is cap-sensitive. Below about 3 percent, a booster is necessary. It is important that the aqueous suspension of aluminum be added to the dry particulate mixture to avoid dusting of the particulate aluminum and to insure a uniform, homogeneous composition which does not segregate.

EXAMPLE 1

The explosive composition described is generally prepared in batches weighing from 200 to 400 pounds each. In a given day 20,000 pounds of the composition may be prepared. To formulate 20,000 pounds of the explosive composition requires 13,750 pounds of particulate prilled ammonium nitrate and 358 pounds of guar gum.

A batch amount of the ammonium nitrate was fed by auger into bin 10 from a bulk facility and then fed through a hammermill which crushed the prills. The crushed ammonium nitrate was then fed by auger 16 into mixer 18 and mixed with a batch amount of guar gum. The dry mixture was tumbled slowly to form a uniform mixture of the oxidizer and dry gelling agent.

An aqueous slurry concentrate of particulate aluminum was prepared by blending together with an impeller, vortex mixer 358 pounds of a de-dusted flake aluminum (Alcoa 1651), 1,076 pounds water, about 10 pounds of a gelling agent (HP 11, hydroxypropyl guar), and 20 pounds of propylene glycol.

The concentrate of the gelatinous mixture of aluminum suspended in the aqueous gel was prepackaged in 300 lb. polyethylene cartridges, each cartridge weighing about 15 pounds, and shipped to the use site. At the use site the packages were slit and added to the batch quantity of the dry particulate mixture of ammonium nitrate in the mixer with slow tumbling. Simultaneously with addition of the aluminum concentrate (or separately) an additional batch amount of water was added to the composition (4,428 pounds water per 20,000 pounds oxidizer). The mixture was blended after introduction of the water and concentrate for a time less than 5 seconds and was then fed into an auger packer which packed it into polyethylene cartridges. The set-up time of the composition ranged from 24 to 48 hours. The blended and formulated explosive composition incorporated the following:

| | Percent |
|---|---|
| Ammonium nitrate | 68.75 |
| Guar gum | 1.79 |
| Water | |
| (1) Present in the aluminum-containing concentrate | 5.38 |
| (2) Added at the time of formulation | 22.14 |

-continued

| | Percent |
|---|---|
| Gelling agent Jaguar HP-11 (Stein-Hall, a division of Celanese Corporation) | 0.05 |
| Propylene glycol | 0.10 |
| Flake aluminum (Alcoa 1651) | 1.79 |

The explosive composition, on plate dent tests, detonated completely and gave plate dents comparable to other slurry explosives.

We claim:

1. A method for making a homogeneous, aqueous slurry-type blasting composition containing a particulate inorganic nitrate oxidizer and a finely divided metal fuel, comprising:

premixing the finely divided metal fuel with water and a gelling agent to form a stable suspension of the finely divided metal fuel in the water;

mixing the aqueous suspension of finely divided metal fuel with the particulate nitrate oxidizer and an additional amount of water; and slowly tumbling the mixture for a brief time sufficient to uniformly mix the components.

2. The method of claim 1, wherein the nitrate oxidizer is mixed with a gelling agent.

3. The method of claim 2, wherein the composition consists essentially of 50–80 percent by weight particulate inorganic nitrate, 0.5 to 10 percent by weight finely divided aluminum flake, 0.5 to 10 percent by weight gelling agent and 15 to 35 percent water.

4. The method of claim 2, wherein the mixing time ranges from 2 to 30 seconds and the inorganic nitrate is ammonium nitrate.

5. A system for making a homogeneous, aqueous, slurry-type blasting composition which contains a particulate nitrate oxidizer, a finely divided metal fuel, and a gelling agent, the system comprising:

grinding means for grinding the particulate nitrate to a uniform particle size;

means for feeding the particulate oxidizer to a mixer having tumbling blades therein which subjects the mixture to a slow tumbling action;

means for feeding into the mixer a gelatinous concentrate consisting essentially of finely divided aluminum in a stable suspension with water and a gelling agent; and means for packing the formulated explosive composition in cartridges.

6. The method of claim 5, wherein the composition consists essentially of 50 to 80 percent by weight nitrate oxidizer, 1 to 4 percent by weight finely divided aluminum, 15 to 35 percent by weight water and 0.5 to 10 percent by weight gelling agent.

7. The system of claim 5, wherein the means for packing is an auger packer.

8. The method of claim 4, wherein mixing of the aqueous suspension of finely divided fuel with the ammonium nitrate results in an endothermic reaction providing thermal stability and insensitivity to detonation.

* * * * *